United States Patent [19]

Colanzi

[11] 4,171,594

[45] Oct. 23, 1979

[54] ELECTRICALLY CONTROLLED WINDOW REGULATOR, PARTICULARLY FOR MOTOR VEHICLES

[75] Inventor: Franco Colanzi, Turin, Italy

[73] Assignee: RIV - SKF Officine Di Villar Perosa S.p.A., Turin, Italy

[21] Appl. No.: 874,606

[22] Filed: Feb. 2, 1978

[30] Foreign Application Priority Data

Feb. 17, 1977 [IT] Italy ..... 67346 A/77

[51] Int. Cl.[2] ..... E05F 15/16; E05F 11/48

[52] U.S. Cl. ..... 49/349; 49/352

[58] Field of Search ..... 49/349, 352, 348, 325

[56] References Cited

U.S. PATENT DOCUMENTS

| | | | |
|---|---|---|---|
| 2,524,714 | 10/1950 | Rappl | 49/349 X |
| 2,919,911 | 1/1960 | Furtah, Jr. | 49/349 X |
| 3,014,716 | 12/1961 | Hitzelberger | 49/352 X |
| 4,074,463 | 2/1978 | Colanzi | 49/349 X |

FOREIGN PATENT DOCUMENTS

| | | | |
|---|---|---|---|
| 453688 | 9/1936 | United Kingdom | 49/325 |
| 1184645 | 3/1970 | United Kingdom | 49/349 |

*Primary Examiner*—Philip C. Kannan

*Attorney, Agent, or Firm*—Ladas, Parry, Von Gehr, Goldsmith & Deschamps

[57] ABSTRACT

An electrically controlled window regulator in which a reversible electric motor is connected via transmission means to a window for movement thereof along fixed guides; said transmission means including an endless flexible member extending along a fixed path having a straight portion arranged parallel to said guides, and at which bracket means are arranged for movement along said straight portion with said flexible member and for connection thereof to said window; said motor having an output shaft on which a nut screw is mounted, and said nut screw being coupled to a flexible screw forming at least part of said flexible member.

5 Claims, 6 Drawing Figures

ELECTRICALLY CONTROLLED WINDOW REGULATOR, PARTICULARLY FOR MOTOR VEHICLES

BACKGROUND OF THE INVENTION

This invention relates to an electrically controlled window regulator, particularly for raising and lowering a mobile window of a motor vehicle door.

In particular, the present invention relates to an electrically controlled window regulator comprising a reversible electric motor and transmission means operable by said motor and fixable to a mobile window to give this latter a translatory movement along slide guides.

In known window regulators of the aforesaid type, the said transmission means generally comprise a slide firmly fixable to said window and mobile, under the thrust of an actuator member operated by said motor, along a rigid guide firmly fixable to an inner wall of a motor vehicle door.

In said known window regulators, the use of a slide such as that described and the relative slide guide has numerous drawbacks of both an operational and economical nature. In this respect, in order to ensure correct movement of the window, the slide guide must generally have a curvature which is variable so as to adapt to the curvature of the door in which it is fitted. Such a variable curvature generally leads to considerable difficulty in obtaining a substantially uniform movement of the slide. Moreover, the resistance to the sliding of the slide along its guide generally varies with time because of the action of atmospheric agents, as the guide is normally exposed to the water which runs along the window during rain. From the economical aspect, the construction and assembly of said curved guide lead to relatively high costs because of the precision which they require for correct operation of the window regulator. However, the aspect which mostly influences the cost of the aforesaid known window regulators, and which substantially limits their use to prestige vehicles, is the fact that they cannot be mass produced. In this respect, generally only the electric motor used can be mass produced, whereas all the other members, and in particular the slide guide, must have a shape and size which vary according to the type of vehicle on which they are used.

Lastly, but of no less importance, the installation of window regulators of the aforesaid known type on medium or economical motor vehicles is little appreciated by the user, because even a slight deformation of the door necessarily requires the replacement of its window regulator, or at least of its slide guide.

SUMMARY OF THE INVENTION

The object of the present invention is to provide an electrically controlled window regulator free from the aforesaid drawbacks, and which in particular is adaptable to any type of motor vehicle at substantially no cost of adaptation.

This object is attained by the electrically controlled window regulator of the aforesaid type, according to the present invention, wherein said transmission means comprise an endless flexible member disposed about at least two idle pulleys, and defining between said two pulleys a straight portion to be disposed in a position substantially parallel to said window guides, and a bracket connected to said flexible member at said straight portion and fixable to said window, said flexible member being constituted at least partly of a flexible screw; said motor having a mechanical exit comprising a rotatable shaft and a nut screw axially fixed relative to said motor and rotatable with said shaft; and said flexible screw extending through said nut screw and being coupled to this latter.

From the aforegoing, it is apparent that the said window regulator is not only adaptable to any type of door by simply utilising a flexible transmission member of a greater or lesser length, but in addition does not comprise any members the operation of which can be influenced by even marked deformation of the relative door.

In a preferred embodiment of the window regulator according to the invention, said flexible screw is rotatably mounted in a conduit rigid with said motor and comprising said nut screw; seal means being disposed betwen said conduit and said flexible member to provide a seal against external atmospheric agents, at least at that end of said conduit which is occupied by said flexible screw.

The said preferred embodiment provides a simple and economical solution, previously impossible because of the use of the said guide and slide, to the problem of corrosion and low reliability which are responsible for the present limited use of electrically controlled window regulators.

BRIEF DESCRIPTION OF THE DRAWINGS

Further characteristics and advantages of the present invention will be evident from the description given hereinafter with reference to the accompanying drawings, which illustrate some non-limiting embodiments thereof, and in which.

DETAILED DESCRIPTION OF THE INVENTION

Figure 1:
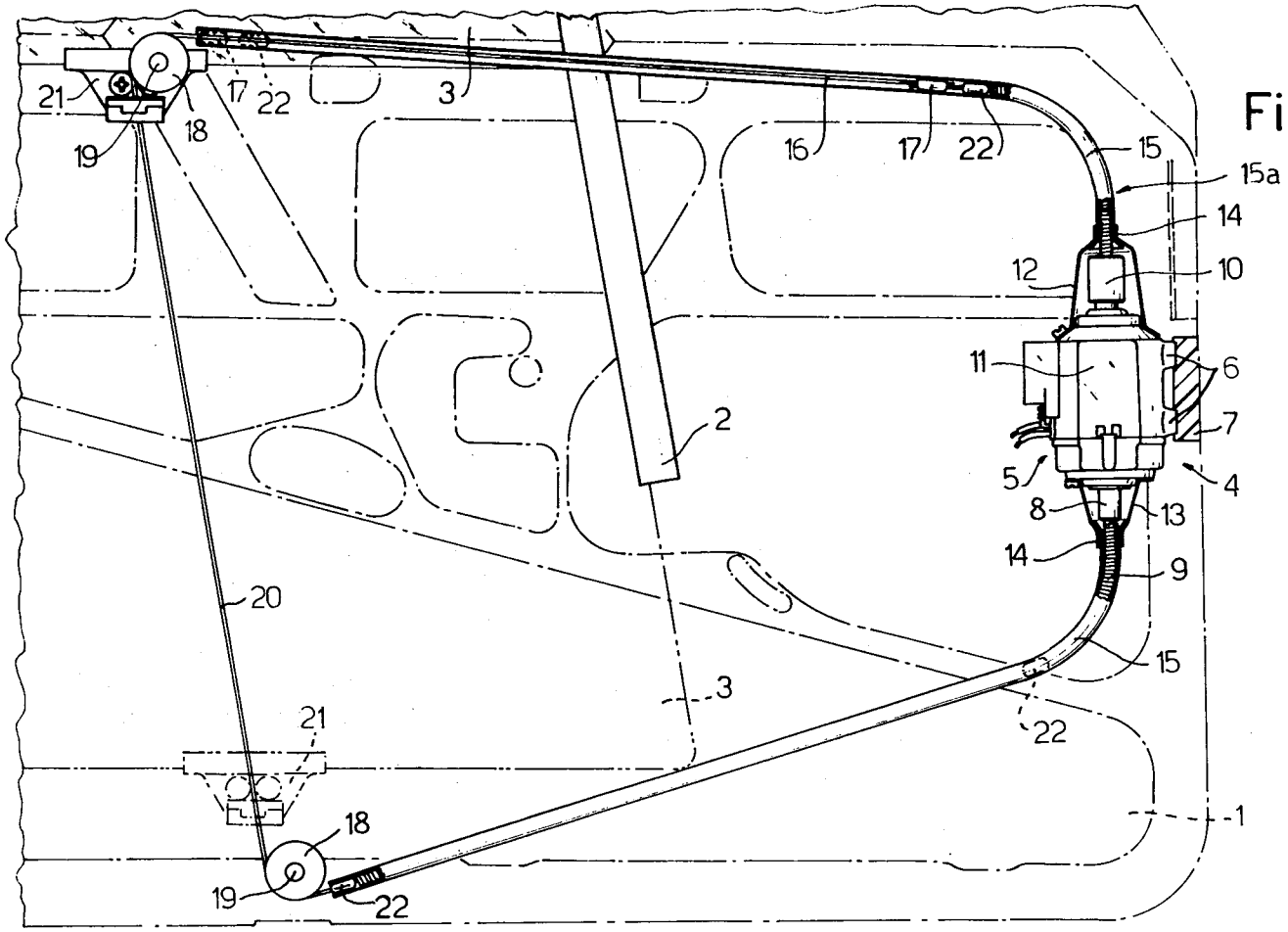
FIG. 1 is a partly sectional elevation of a window regulator mounted on a motor vehicle door and constructed in accordance with the present invention.

FIG. 1 shows the interior of a motor vehicle door 1, in which a mobile window 3 is slidably mounted in suitable channel guides 2 (of which only one is shown in the figure), and is arranged to be moved between an upper closed position and a lower open position (shown by a dashed and dotted line in FIG. 1) by an electrically controlled window regulator indicated overall by 4.

The regulator 4 comprises an electric motor 5 with feet 6 for fixing it to a rib of the frame of the door 1 by way of a block 7. The motor 5 comprises a hollow through shaft 8, through which extends a flexible screw member 9 constituted of a precompressed spring which is coupled to a nut screw 10 keyed on to one end of the shaft 8 which extends outwards from a casing 11 of the motor 5. The two ends of the shaft 8 which emerge from the casing 11 are protected by two caps 12 and 13 fixed to the casing 11 in a position coaxial to the shaft 8, and each comprising, at the opposite end to the end facing the casing 11, a tubular appendix 14 in which the end of a tubular curved sheath 15 is seal mounted. The two sheaths 15, together with the caps 12 and 13, nut screw 10 and shaft 8, constitute a conduit 15*a* through which the flexible member 9 is movably mounted.

Inside the flexible member 9 there is mounted a cable 16, the ends of which are connected together by a joining element 17 to form a loop, one portion of which extends outside the sheaths 15 and winds about two pulleys 18 rotatably mounted on respective pivots 19 carried by the door 1 and disposed such that the straight portion of cable 16 between them is substantially parallel to the guides 2. A bracket 21 is connected to the cable 16 on said straight portion, indicated by 20, for connecting the cable 16 to the lower end of the window 3.

Figure 2:
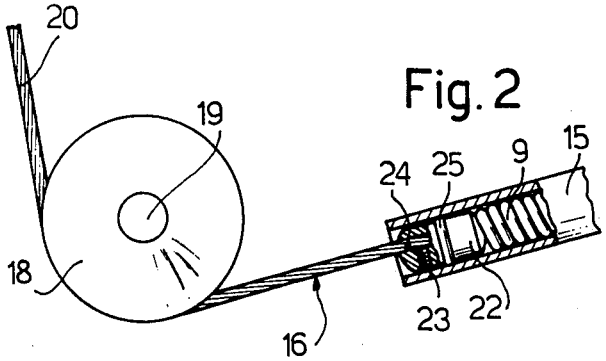
FIG. 2 is a partly sectional view to an enlarged scale of a detail of FIG. 1.

The cable 16 is made rigid with the flexible member 9 by two tubular clamping elements 22 rigid with the two ends of the flexible member 9 and traversed by the cable 16. As shown in FIG. 2, each element 22 is of substantially cylindrical shape and is provided with at least one radial clamping screw 23 cooperating with the cable 16 to fix it inside an axial through bore 24 provided in the element 22.

In the embodiment shown in FIG. 2, each element 22 is arranged to seal against the inner surface of the respective sheath 15 in order to make that end of the said slide conduit 15*a* occupied at any moment by the flexible member 9 inaccessible to external atmospheric agents. In order to ensure the existence of said seal, an outer ring 25 is mounted on each element 22 to slidably cooperate in a sealed manner with the respective sheath 15.

Figure 4:
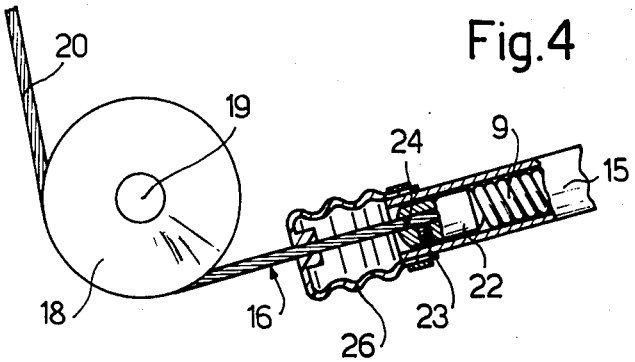
FIG. 4 is a partly sectional view of a first modification of the detail of FIG. 2.

In the modification shown in FIG. 4, said seal is ensured by a bellows gasket 26 mounted on each end of the sheath 15 and arranged to seal against the cable 16. In this manner the entire conduit 15*a* is made inaccessible from the outside.

Figure 3:
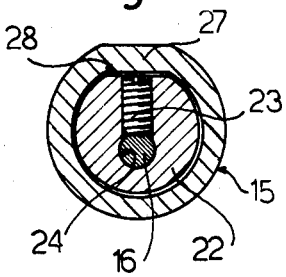
FIG. 3 is a section through a modified detail of FIG. 1.

In the modification shown in FIG. 3, the sheath 15 comprises a flat face 27 cooperating with a corresponding flat surface 28 provided on the respective element 22, to prismatically guide the flexible member 9 during its movement along the conduit 15*a*. Such a guide is generally appropriate only when the curvature of the sheaths 15 is relatively small and the flexible member 9 tends to rotate about its own axis together with the nut screw 10.

Figure 5:
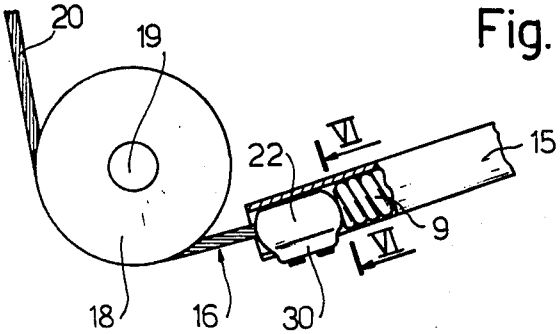
FIG. 5 is a partly sectional view of a second modification of the detail of FIG. 2.
Figure 6:
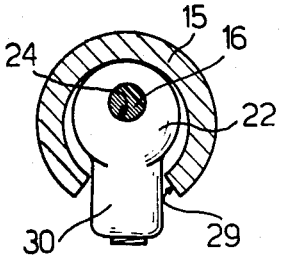
FIG. 6 is a section on the line VI—VI of FIG. 5 to an enlarged scale.

FIGS. 5 and 6 show another method of providing a prismatic coupling between the flexible member 9 and sheaths 15. This coupling is made by providing an axial slot 29 in each sheath 15 and using a clamping element 22 provided with a radial appendix 30 which emerges from the relative sheath 15 through its slot 29.

Because of the constructional simplicity of the described window regulator 4, any description of its operation is unnecessary. However, reference should be made to the face that by simply varying the length of the cable 16, the device 4 may be adapted to the door of any motor vehicle, and even if the door becomes deformed, the device 4 continues generally to operate.

Numerous modifications can be made to the described window regulator within the principle of the invention, without leaving the scope of the inventive idea.

What I claim is:

1. An electrically controlled window regulator, particularly for motor vehicles and comprising a reversible electric motor and transmission means operable by said motor and fixable to a mobile window to give this latter a translatory movement along slide guides, wherein said transmission means comprise an endless flexible member disposed about at least two idle pulleys, and defining between said two pulleys a straight portion to be disposed in a position substantially parallel to said slide guides, and a bracket connected to said flexible member at said straight portion and fixable to said window, said flexible member being constituted at least partly of a flexible screw; said motor having a mechanical output comprising a rotatable shaft and a nut screw axially fixed relative to said motor and rotatable with said shaft; and said flexible screw extending through said nut screw and being threadedly coupled thereto, and wherein said flexible screw is rotatably mounted in a conduit which is rigidly connected to said motor and includes said nut screw; and seal means being disposed between said conduit and said flexible member to provide a seal against external atmospheric agents, said seal means comprising a plug connected to each end of said screw and mounted to slide in a sealed manner along at least part of said conduit.

2. An electrically controlled window regulator, particularly for motor vehicles and comprising a reversible electric motor and transmission means operable by said motor and fixable to a mobile window to give this latter a translatory movement along slide guides, wherein said transmission means comprise an endless flexible member disposed about at least two idle pulleys, and defining between said two pulleys a sraight portion to be disposed in a position substantially parallel to said slide guides, and a bracket connected to said flexible member at said straight portion and fixable to said window; said flexible member being constituted at least partly of a flexible screw; said motor having a mechanical output comprising a rotatable shaft and a nut screw axially fixed relative to said motor and rotatable with said shaft; and said flexible screw extending through said nut screw and being threadedly coupled thereto, and wherein said flexible screw is rotatably mounted in a conduit which is rigidly connected to said motor and includes said nut screw; and seal means being disposed between said conduit and said flexible member to provide a seal against external atmospheric agents, at least at that end of said conduit which is occupied by said flexible screw, and wherein said conduit has a cross-section, along at least part of its length, such as to constitute a prismatic guide for slide means carried by said flexible screw.

3. An electrically controlled window regulator, particularly for motor vehicles and comprising a reversible electric motor and transmission means operable by said motor and fixable to a mobile window to give this latter a translatory movement along slide guides, wherein said transmission means comprise an endless flexible member disposed about at least two idle pulleys, and defining between said two pulleys a straight portion to be disposed in a position substantially parallel to said slide guides, and a bracket connected to said flexible member at said straight portion and fixable to said window; said flexible member being constituted at least partly of a flexible screw; said motor having a mechanical output comprising a rotatable shaft and a nut screw axially fixed relative to said motor and rotatable with said shaft; and said flexible screw extending through said nut screw and being threadedly coupled thereto, and wherein said flexible screw is rotatably mounted in a conduit which is rigidly connected to said motor and includes said nut screw; and seal means being disposed between said conduit and said flexible member to provide a seal against external atmospheric agents, wherein said flexible member comprises a cable cooperating with said pulleys and rigid with two ends of said flexible screw, and said seal means comprise two annular seal elements mounted at the two ends of said conduit and traversed in a sealed manner by said cable.

4. A window regulator as claimed in claim 1, 2 or 3, wherein said electric motor is of the hollow through shaft type, said nut screw being keyed on to said shaft in a position coaxial therewith, and said flexible screw extending through said hollow shaft.

5. A window regulator as claimed in claim 1 or 2, wherein said flexible member comprises a cable cooperating with said pulleys and rigid with the two ends of said flexible screw.

* * * * *